US006267654B1

(12) United States Patent
Lai et al.

(10) Patent No.: US 6,267,654 B1
(45) Date of Patent: Jul. 31, 2001

(54) PAD BACKER FOR POLISHING HEAD OF CHEMICAL MECHANICAL POLISHING MACHINE

(75) Inventors: Chien-Hsin Lai, Kaohsiung Hsien; Jung-Nan Tseng, Hsinchu Hsien; Huang-Yi Lin, Taichung Hsien; Hui-Shen Shih, Changhua Hsien, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/586,301

(22) Filed: Jun. 2, 2000

(51) Int. Cl.[7] ..... B24B 7/22
(52) U.S. Cl. ..... 451/288; 451/533; 451/530
(58) Field of Search ..... 451/530, 533, 451/288, 287, 490, 526, 270, 41

(56) References Cited

U.S. PATENT DOCUMENTS 5,212,910 * 5/1993 Breivogel et al. ..... 451/287
5,664,989 * 9/1997 Nakata et al. ..... 451/288
5,876,271 * 3/1999 Oliver ..... 451/41
5,897,424 * 4/1999 Evans et al. ..... 451/41
5,899,799 * 5/1999 Tjaden et al. ..... 451/41

FOREIGN PATENT DOCUMENTS

0036066 * 2/1990 (JP) ..... 51/293

* cited by examiner

*Primary Examiner*—Robert A. Rose
(74) *Attorney, Agent, or Firm*—Jiawei Huang; J. C. Patents

(57) ABSTRACT

A pad backer for a polishing head of a chemical mechanical polishing machine is described wherein scribe lines in the x-direction and in the y-direction are formed on the surface of the pad backer. Additional scribe lines are formed at angles of about 45 degrees and about 135 degrees from the x-direction scribe lines to increase the usage rate of the polishing pad.

5 Claims, 3 Drawing Sheets

PAD BACKER FOR POLISHING HEAD OF CHEMICAL MECHANICAL POLISHING MACHINE

BACKGROUND OF THE INVENTION

1. Field of the Invention

The present invention relates to a chemical mechanical polishing machine. More particularly, the present invention relates to a pad backer for the polishing head of a chemical mechanical polishing machine.

2. Description of the Related Art

In semiconductor wafer fabrication, chemical mechanical polishing, is applied to planarize various material layers, including the dielectric layers and the metallization layers. The planarity of the wafers is critical for many reasons. For example, during wafer fabrication, a planar layer reduces the likelihood of the accidental coupling of active conductive devices between different metallization layers. Planar layers further provide a surface absent in height differences to facilitate the subsequent photolithography process.

Chemical mechanical polishing typically involves mounting a wafer on a holder, facing down, and rotating the wafer against a polishing pad mounted on a platen. The platen is usually rotating in an orbital state. Slurry containing a chemical that chemically interacts with the wafer surface layer and an abrasive that physically removes a portion of the surface layer is supplied between the wafer and the polishing pad.

The polishing pad is normally applied to the wafer under a polishing pressure to maintain a uniform level across the wafer. In order to maintain a uniform polishing pressure, the polishing pad is attached to a flexible platen or pad backer. An air bladder, which can be inflated, is disposed between a plumbing device and the pad backer and is arranged to essentially press against the bottom surface of the pad backer.

As shown in FIG. 1, the conventional pad backer 100 comprises scribe lines 102 in the x and the y directions on the pad backer 100 surface. The x-direction scribe lines and the y-direction scribe lines intersect to form a grid of square 104. During a CMP process, a polishing air pressure is applied to the pad backer 100. The pad backer 100, in turns, presses against the polishing pad. After the CMP process, however, by-product patterns are shown to appear on the polishing pad.

FIG. 2 is a top view of the conventional pad backer having the by-product pattern on the polishing pad superimposed onto the pad backer. As shown in FIG. 2, the by-product patterns 202 occur in the center of each square 204 on the pad backer 200. The by-product pattern 202, however, is missing on the polishing pad in the vicinity at the cross-sections 206 of the scribe lines. The formation of the alternating by-product pattern 202 suggests a low usage probability of the polishing pad, which leads to an undesirable polishing result

SUMMARY OF THE INVENTION

Based on the foregoing, a pad backer for a polishing head of a chemical mechanical polishing machine is provided. The pad backer comprises a series of scribe lines in the x and the y directions on the pad backer surface. Additional scribe lines are formed at angles of about 45 degree and 135 degrees from the x-direction scribe lines.

The additional scribe lines increase the usage probability of the polishing pad. The formation of the by-product patterns on the polishing pad and undesirable polishing result are thereby obviated.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the description, serve to explain the principles of the invention. In the drawings.

DESCRIPTION OF THE PREFERRED EMBODIMENT

Figure 1:
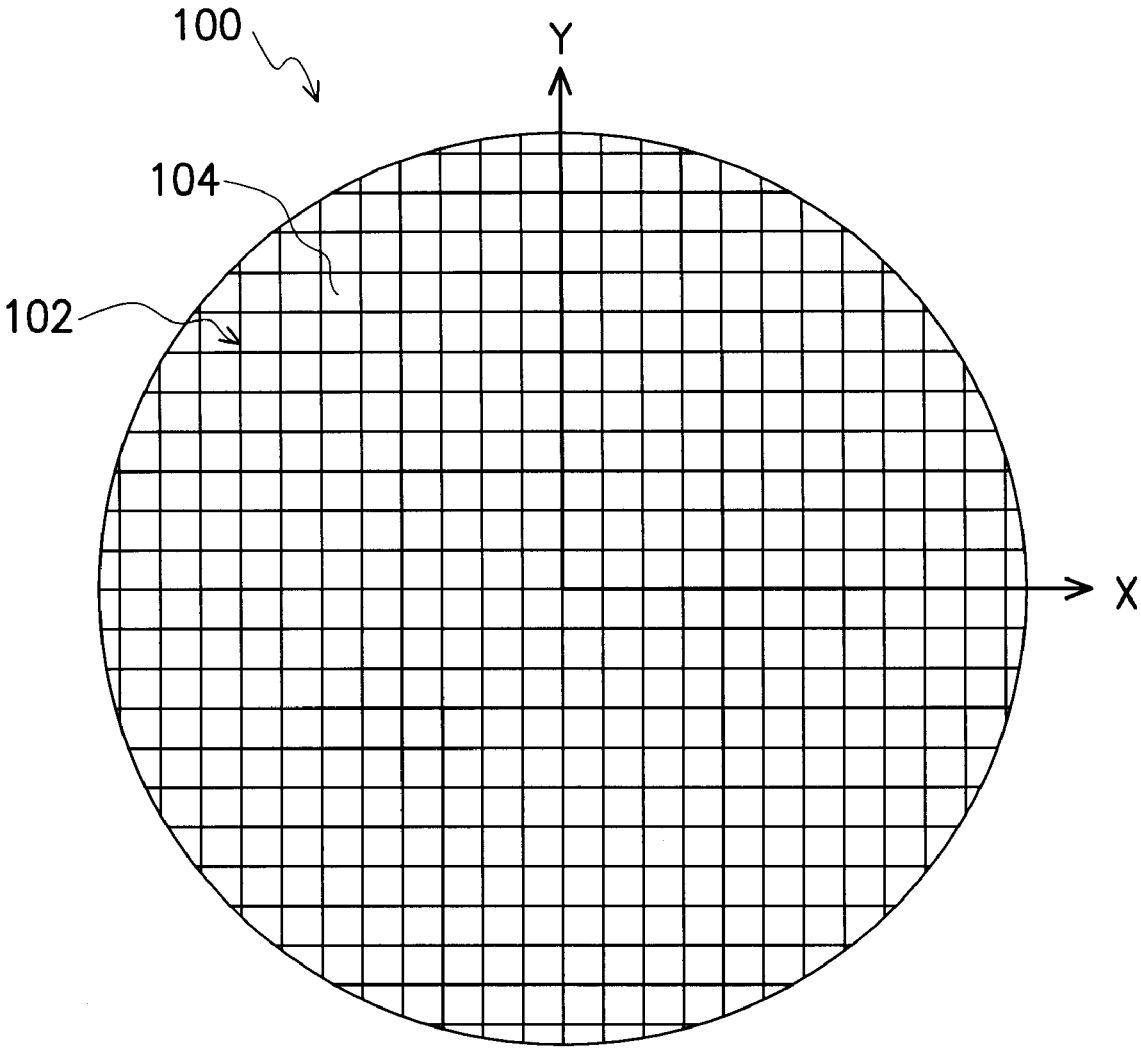
FIG. 1 (PRIOR ART)
FIG. 1 is a schematic, top view of a conventional polishing backer for a chemical mechanical polishing machine.
Figure 2:
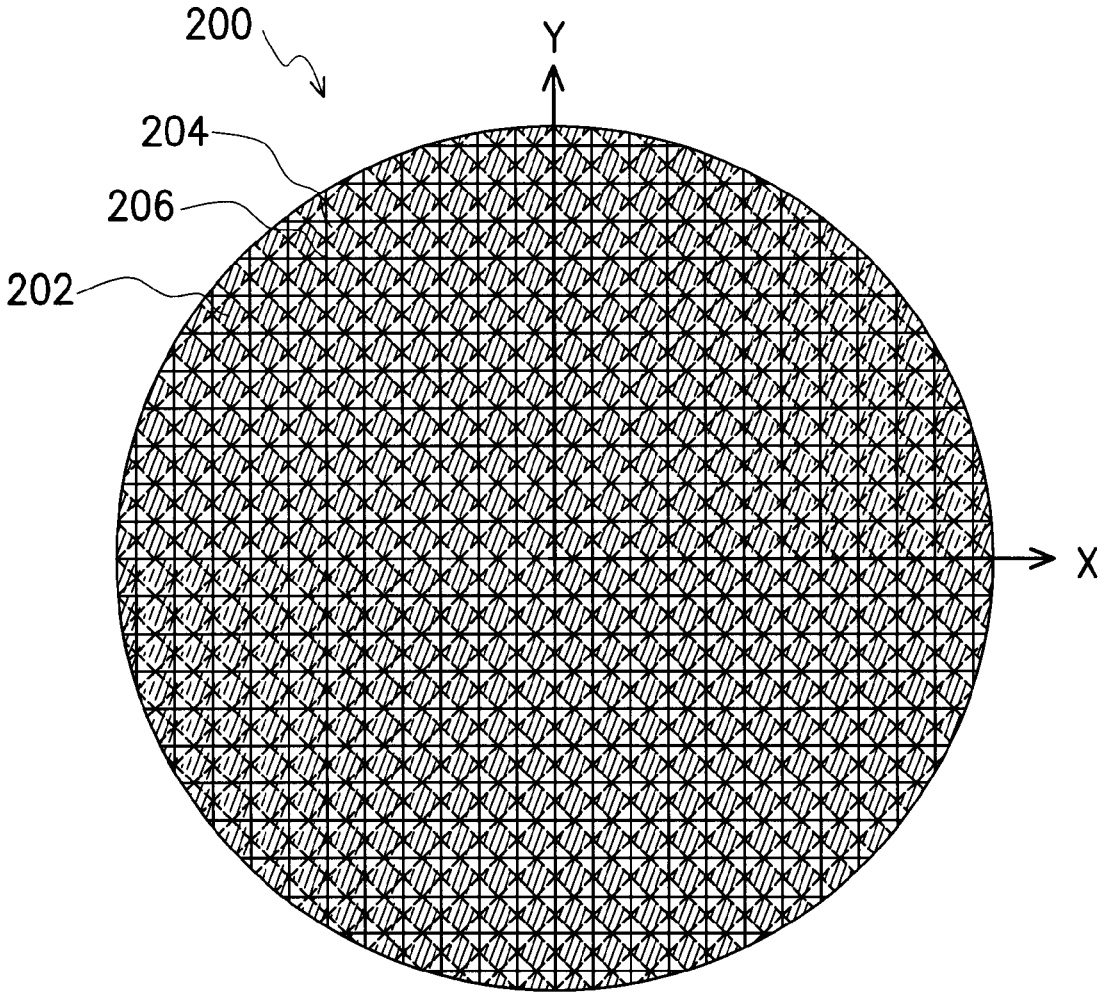
FIG. 2 (PRIOR ART)
FIG. 2 is a schematic, top view of the conventional pad backer, having the by-product patterns on the polishing pad are superimposed onto the pad backer.
Figure 3:
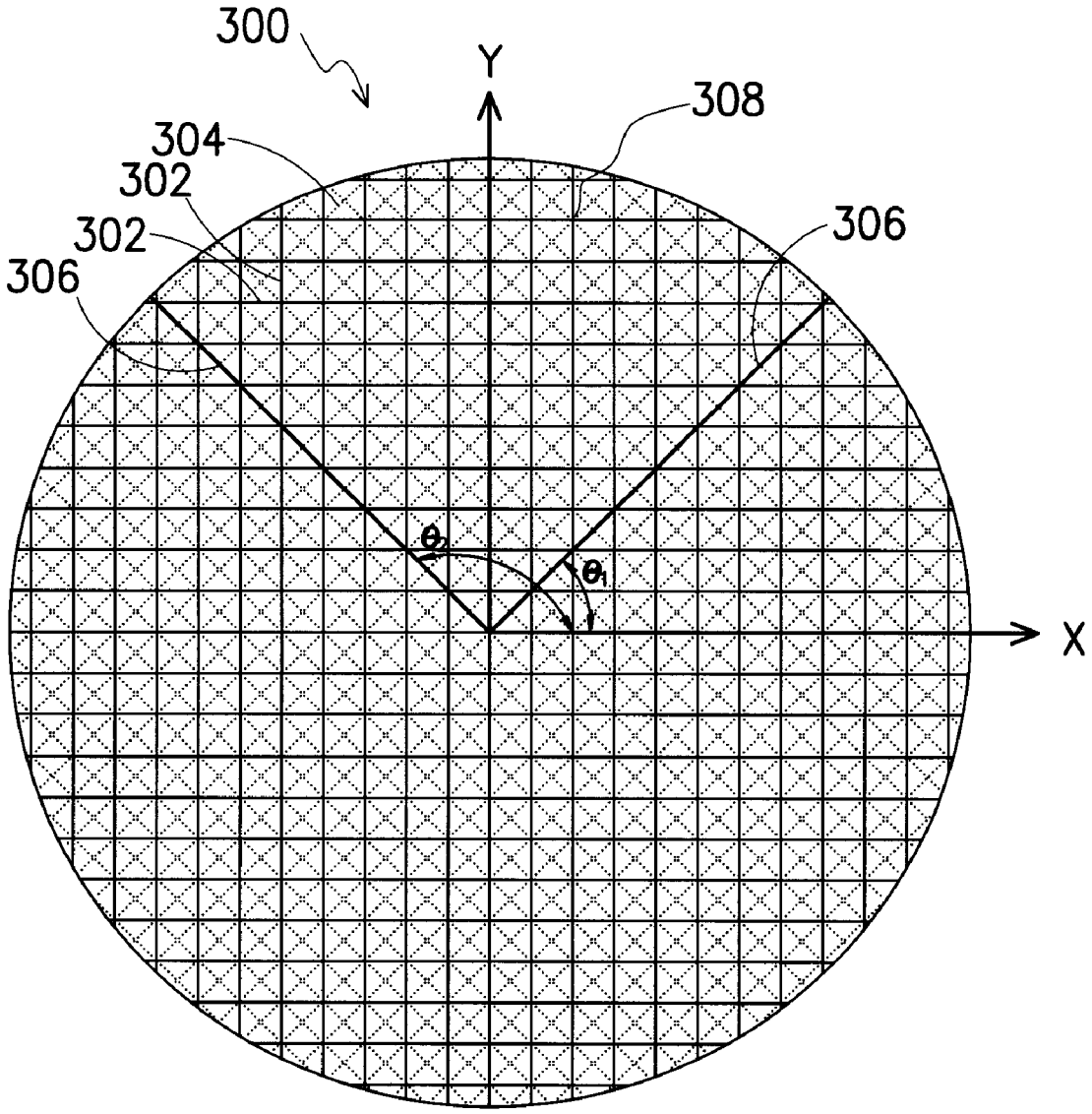
FIG. 3 is a schematic, top view of a pad backer for a chemical mechanical polishing machine according to a preferred embodiment of the present invention.

FIG. 3 is a schematic, top view of a pad backer for a chemical mechanical polishing machine according to a preferred embodiment of the present invention.

As shown in FIG. 3, a flexible platen 300 is provided. The flexible platen 300 comprises a plurality of parallel scribe lines 302 in the x-direction and a plurality of parallel scribe lines 302 in the y-direction on the flexible platen 300 surface. The x-direction scribe lines 302 and the y-direction scribe lines 302 intersect at 90 degrees to form a grid of square pattern 304.

Still referring to FIG. 3, additional scribe lines 306 are formed at an angle $\hbar$ from the x-direction scribe lines 302, passing through the intersection 308 between the x-direction scribe lines 302 and the y-direction scribe lines 302. Additional scribe lines 306 are also formed at an angle $\hbar$ from the x-direction scribe lines 302, passing through the intersection 308 between the x-direction scribes lines 302 and the y-direction scribe lines 302. The angle $\hbar$ is ranged from about 22.5 degrees to about 67.5 degrees, and is preferably at about 45 degrees. The angle $\hbar$ is ranged from about 112.5 degrees to about 157.5 degrees, and is preferably at about 135 degrees.

When the polishing air pressure is applied to the polishing pad, the additional scribe lines 306 increase the usage probability of the polishing pad. The formation of the alternating by-product pattern on the polishing pad is thus mitigated and the lifetime of the polishing pad is extended.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pad backer for a polishing head of a chemical mechanical polishing machine comprising:

a flexible platen;

a plurality of parallel first scribe lines in a first direction;

a plurality of parallel second scribe lines in a second direction, intersecting the first scribe lines at 90 degrees;

a plurality of parallel third scribe lines at a first angle from the first scribe lines, passing through the intersections between the first scribe lines and the second scribe lines; and a plurality of parallel fourth scribe lines at a second angle from the first scribe lines, passing through the intersections between the first scribe lines and the second scribe lines.

2. The pad backer according to claim 1, wherein the first angle is between about 22.5 degrees to about 67.5 degrees.

3. The pad backer according to claim 1, wherein the first angle is about 45 degrees.

4. The pad backer according to claim 1, wherein the second angle is about 112.5 degrees to about 157.5 degrees.

5. The pad backer according to claim 1, wherein the second angle is about 135 degrees.

* * * * *